United States Patent [19]

Himmelbauer

[11] Patent Number: 4,607,190

[45] Date of Patent: Aug. 19, 1986

[54] TELEVISION CAMERA TUBE WITH CONDUCTIVE WALL COATING AND TRANSVERSELY WALL SUPPORTED ELECTRODE

[75] Inventor: Erich E. Himmelbauer, Eindhoven, Netherlands

[73] Assignee: U.S. Philips Corporation, New York, N.Y.

[21] Appl. No.: 666,810

[22] Filed: Oct. 31, 1984

[30] Foreign Application Priority Data

May 7, 1984 [NL] Netherlands ..... 8401445

[51] Int. Cl.[4] ..... H01J 29/02; H01J 29/88

[52] U.S. Cl. ..... 313/479; 313/283; 313/390; 313/482

[58] Field of Search ..... 313/479, 477 R, 482, 313/365, 390, 283

[56] References Cited

U.S. PATENT DOCUMENTS 2,828,433 3/1958 Frenkel ..... 313/482

4,276,494 6/1981 Roosmalen et al. ..... 313/479

OTHER PUBLICATIONS van Roosmalen, J. H. T., et al., "A New Concept for Television Camera Tubes, *Philips Technical Review,* vol. 39, No. 8, pp. 201-210 (1980).

*Primary Examiner*—Palmer C. DeMeo

*Attorney, Agent, or Firm*—Marc D. Schechter

[57] ABSTRACT

Television camera tube comprising a tubular envelope of glass drawn on a mandril and having an internal conductive wall coating. A diaphragm having an aperture is supported in the envelope by a supporting surface extending transverse to the longitudinal axis of the envelope. The supporting surface is formed by a substantially stepwise change in the internal transverse dimension of the envelope. The conductive wall coating is interrupted at a distance from the diaphragm. The stepwise change in the internal transverse dimension of the envelope portion taking place in at least a first a step and second step. The first step forms the supporting surface for the diaphragm. The interruption (6) in the conductive wall coating is provided on the second step. If the diaphragm in such a tube is a flat plate and the distance d between the first step and the second step is between 0.4 D and D, where D is the inside diameter of the envelope between the first and the second step, the axial astigmatism.

1 Claim, 5 Drawing Figures

FIG. 1
(PRIOR ART)
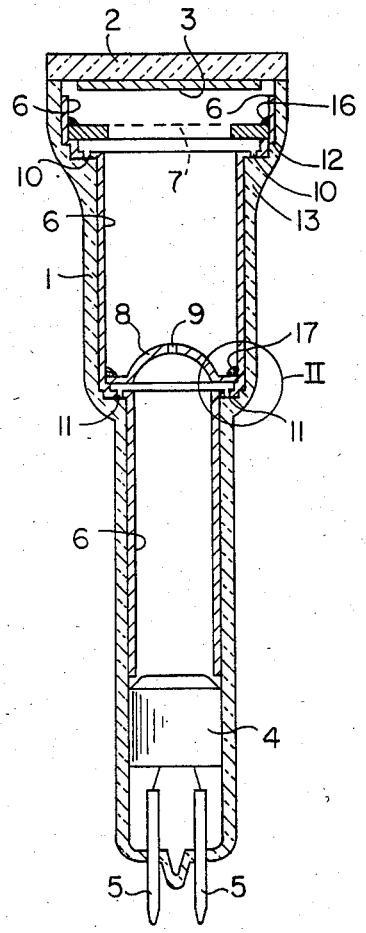
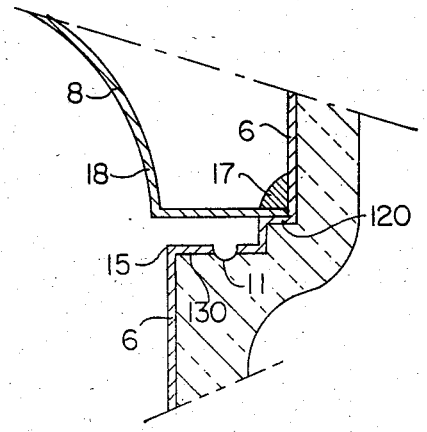
FIG. 2
(PRIOR ART)

TELEVISION CAMERA TUBE WITH CONDUCTIVE WALL COATING AND TRANSVERSELY WALL SUPPORTED ELECTRODE

BACKGROUND OF THE INVENTION

The invention relates to a television camera tube. The camera tube comprises a tubular envelope of glass drawn on a mandril. The envelope has an internal wall with a conductive coating. An apertured diaphragm is supported in the envelope portion by a supporting surface extending transverse to the longitudinal axis of the envelope portion. The supporting surface is formed by a substantially stepwise change in the internal transverse dimension of the envelope portion. The conductive wall coating is interrupted at a distance from the diaphragm. The stepwise change of the internal transverse dimension of the envelope portion is made up of at least a first step and a second step, the first step forms the supporting surface for the diaphragm. The interruption in the conductive wall coating is provided on the second step.

Such a television camera tube is known from Netherlands patent application 7807758 (corresponding to U.S. Pat. No. 4,276,494). The camera tube described in this patent application comprises a spherical diaphragm which has an aperture. The spherical part of the diaphragm extends from the interruption in the wall coating into the envelope portion which is provided with the conductive coating which is electrically connected to the diaphragm. As a result of the curvature of the diaphragm, at the area of the aperture in the diaphragm the axial field strength is considerably lower than at the area of the interruption. This is necessary so as to keep the spherical aberration of the electron lens formed in the interruption small.

It has now been found that small deviations from the roundness of the spherical diaphragm, or of diaphragms having the form of a truncated cone, have an adverse influence on the electron lens. In order to avoid disturbing axial astigmatism, very high requirements have to be imposed upon the roundness of the spherical or conical diaphragm, which requirements are diffucult to meet in a metal component which has been manufactured by means of deep drawing.

SUMMARY OF THE INVENTION

It is therefore an object of the invention to provide a television camera tube in which the diaphragm has such a shape and location that axial astigmatism is substantially eliminated.

For that purpose, in a television camera tube according to the invention, the diaphragm is a flat plate and the distance d between the first step and the second step is between 0.4 D and D, where D is the inside diameter of the envelope portion between the first and the second step.

Because the conductive wall coating between the diaphragm and the interruption has highly accurate dimensions in tubes drawn on a mandril, the electron lens with a diaphragm according to the invention is an improvement as compared with known deep drawn diaphragms which exhibit unroundnesses. Axial astigmatism does not substantially occur.

BRIEF DESCRIPTION OF THE DRAWING

FIG. 1 is a longitudinal sectional view of a prior art television camera tube.

FIG. 2 shows a detail of the tube of FIG. 1.

DESCRIPTION OF THE PREFRRED EMBODIMENTS

Figure 3:
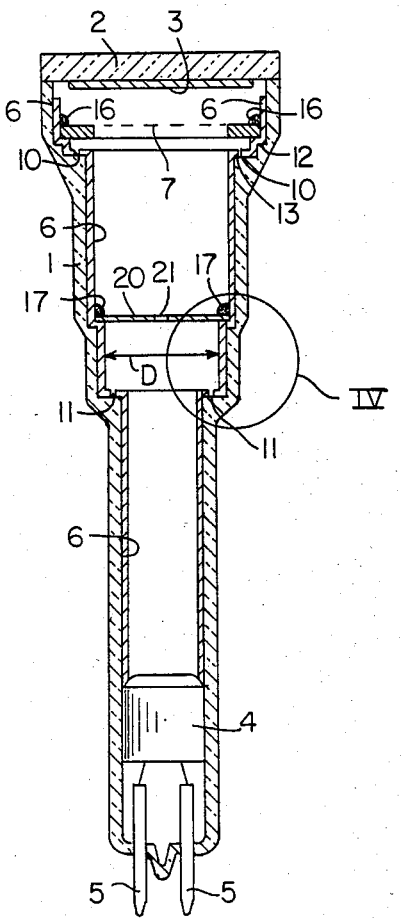
FIG. 3 is a longitudinal sectional view of a television camera tube according to the invention.

The prior art television camera tube shown in FIG. 1 comprises a glass envelope 1 which is sealed at one end by a glass window 2 having a target 3. An electron gun 4, to which desired electrical voltage can be applied via a number of leadthrough pins 5, is present in the tube.

The inner wall of the envelope 1 is coated with a thin layer of nickel 6 by a known process, for example electroless nickel plating. The tube further comprises a gauze electrode 7 and a diaphragm 8. Diaphragm 8 has an aperture 9. An electron beam generated by the electron gun 4 through aperture 9 before the beam lands on the photosensitive layer 3. The nickel layer 6 is interrupted around its entire circumference in the proximity of the gauze electrode 7 and the diaphragm 8, so that the layer is separated into three parts. Each of these parts forms a wall electrode which contributes to the formation of the shape and dimensions of the electron beam on the photosensitive layer 3.

In order to minimize field disturbing influences of the interruptions 10 and 11 in the layer 6, as shown in detail in FIG. 2 the inside diameter of the envelope 1 at the area of the gauze electrode 7 and the diaphragm 8 decreases stepwise. Each of these reductions takes place in a first step 12 or 120 and a second step 13 or 130. The first steps 12 and 120 constitute supporting surfaces for the gauze electrode 7 and the diaphragm 8, respectively. The interruptions 10 and 11 are provided on wall portions of the second steps 13 and 130, respectively. These interruptions have been obtained by locally grinding away the wall coating 6. The locations of the interruptions 10 and 11 on the steps 13 and 130 avoids any disturbing influence on the form and the direction of the electron beam.

The gauze electrode 7 and the diaphragm 8 are mechanically and electrically connected to the nickel layer 6 on the sides remote from the supporting surfaces. Spheres 16 and 17 of indium are present in field-free spaces so that these spheres cannot disturb the form and the direction of the electron beam.

FIG. 2 shows a detail of FIG. 1 in a cross-sectional view. The diaphragm 8 is manufactured by deepdrawing from 0.5 mm thick NiCr (80/20%) sheet material. If the spherical part 18 of the diaphragm present near the interruption 11 is not very precisely circular, astigmatism is introduced into the electron beam. The parts of the electrically conductive wall coating (the nickel layer 6) separated by the interruption form an electron lens by applying a suitable voltage, which lens is made astigmatic by a nonspherical diaphragm 18.

Figure 4:
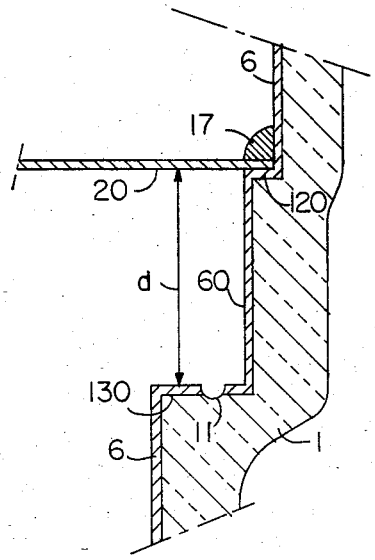
FIG. 4 shows a detail of the tube of FIG. 3.

The television camera tube according to the invention shown in FIG. 3, has a flat diaphragm 20 with a central aperture 21 present at a distance of 7.5 mm from the interruption 11. The diameter D of the envelope portion between the two steps is 15.5 mm. The result of this location of the diaphragm with respect to the interruption is that at the area of the aperture 21 the axial field strength is considerably lower than at the area of the interruption, so that the spherical aberration of the electron lens is kept small. Because the envelope has been manufactured by drawing a glass tube on a mandril, the wall coating 60 between the first step 120 and the second step 130 (see also the detail of FIG. 4) constitutes a substantially true circular cylinder, so that the axial astigmatism which rather frequently occurs in the known diaphragms, does not occur now.

The distance d between steps 120 and 130 must be between 0.4 D and D, where D is the diameter of the envelope between the first step 120 and the second step 130. This approaches the location of the diaphragm according to the prior art. The remaining reference numerals are the same as those of FIG. 1, for clarity.

Figure 5:
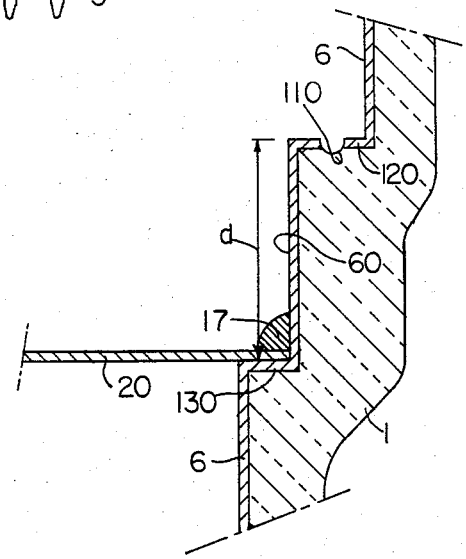
FIG. 5 shows an alternative for the detail shown in FIG. 4.

Of course it is also possible to support the diaphragm 20 with the second step 130 and to provide the interruption 110 on the first step 120, as is shown in FIG. 5. The reference numerals in FIG. 5 have been chosen to be the same as those of FIG. 4.

The use of a flat diaphragm in combination with wall electrodes in the manner according to the invention only makes sense in tubes having glass envelope which have been drawn on a mandril and hence are nearly 100% circular. So far, this tube technology is used only by Philips and is described in an article by J. H. T. van Roosmalen entitled "A new concept for television camera tubes" (Philips Technical Review, Vol. 39, No. 8, pages 201–210 1980), which publication may be considered to be incorporated herein by reference.

What is claimed is:

1. A television camera tube comprising:

a tubular glass envelope drawn on a mandril, said envelope having a longitudinal axis, said envelope having an internal wall having internal dimensions transverse to the longitudinal axis and first and second stepped changes in said internal dimensions, said first and second steps extending transverse to the longitudinal axis;

an apertured diaphragm supported in the envelope by the first step; and a conductive coating provided on the internal wall of the envelope, said coating being interrupted on the second step;

characterized in that:

the diaphragm is a flat plate;

the envelope has a diameter, D, between the first and second steps; and the first and second steps are separated by a distance, d, equal to between 0.4 D and D.

* * * * *